US008618405B2

(12) United States Patent
Tansley

(10) Patent No.: US 8,618,405 B2
(45) Date of Patent: Dec. 31, 2013

(54) FREE-SPACE GESTURE MUSICAL INSTRUMENT DIGITAL INTERFACE (MIDI) CONTROLLER

(75) Inventor: Dennis Stewart Tansley, Issaquah, WA (US)

(73) Assignee: Microsoft Corp., Redmond, WA (US)

( * ) Notice: Subject to any disclaimer, the term of this patent is extended or adjusted under 35 U.S.C. 154(b) by 142 days.

(21) Appl. No.: 12/963,866

(22) Filed: Dec. 9, 2010

(65) Prior Publication Data

US 2012/0144979 A1 Jun. 14, 2012

(51) Int. Cl.
*G10H 7/00* (2006.01)

(52) U.S. Cl.
USPC ..... 84/645; 84/724

(58) Field of Classification Search
USPC ..... 84/723, 645, 724
See application file for complete search history.

(56) References Cited

U.S. PATENT DOCUMENTS 4,288,078 A 9/1981 Capper et al.
4,627,620 A 12/1986 Yang
4,630,910 A 12/1986 Ross et al.
4,645,458 A 2/1987 Williams
4,695,953 A 9/1987 Blair et al.
4,702,475 A 10/1987 Elstein et al.
4,711,543 A 12/1987 Blair et al.
4,751,642 A 6/1988 Silva et al.
4,796,997 A 1/1989 Svetkoff et al.
4,809,065 A 2/1989 Harris et al.
4,817,950 A 4/1989 Goo
4,843,568 A 6/1989 Krueger et al.
4,893,183 A 1/1990 Nayar
4,901,362 A 2/1990 Terzian
4,925,189 A 5/1990 Braeunig
4,968,877 A * 11/1990 McAvinney et al. ..... 250/221
5,101,444 A 3/1992 Wilson et al.
5,148,154 A 9/1992 MacKay et al.

(Continued)

FOREIGN PATENT DOCUMENTS

CN 201254344 B 6/2010
EP 0583061 A2 2/1994

(Continued)

OTHER PUBLICATIONS

Wanderley, et al., "Gestural Control of Sound Synthesis", Retrieved at << http://ieeexplore.ieee.org/stamp/stamp.jsp?tp=&arnumber=1278687 >>, Proceedings of the IEEE, vol. 92, Issue 04, Apr. 2004, pp. 632-644.

(Continued)

*Primary Examiner* — Jeffrey Donels
(74) *Attorney, Agent, or Firm* — Lyon & Harr, LLP; Katrina A. Lyon

(57) ABSTRACT

The free-space gesture MIDI controller technique described herein marries the technologies embodied in a free-space gesture controller with MIDI controller technology, allowing a user to control an infinite variety of electronic musical instruments through body gesture and pose. One embodiment of the free-space gesture MIDI controller technique described herein uses a human body gesture recognition capability of a free-space gesture control system and translates human gestures into musical actions. Rather than directly connecting a specific musical instrument to the free-space gesture controller, the technique generalizes its capability and instead outputs standard MIDI signals, thereby allowing the free-space gesture control system to control any MIDI-capable instrument.

17 Claims, 4 Drawing Sheets

(56) References Cited

U.S. PATENT DOCUMENTS 5,184,295 A 2/1993 Mann
5,229,754 A 7/1993 Aoki et al.
5,229,756 A 7/1993 Kosugi et al.
5,239,463 A 8/1993 Blair et al.
5,239,464 A 8/1993 Blair et al.
5,288,078 A 2/1994 Capper et al.
5,288,938 A 2/1994 Wheaton
5,295,491 A 3/1994 Gevins
5,320,538 A 6/1994 Baum
5,347,306 A 9/1994 Nitta
5,385,519 A 1/1995 Hsu et al.
5,405,152 A 4/1995 Katanics et al.
5,417,210 A 5/1995 Funda et al.
5,423,554 A 6/1995 Davis
5,454,043 A 9/1995 Freeman
5,469,740 A 11/1995 French et al.
5,495,576 A 2/1996 Ritchey
5,516,105 A 5/1996 Eisenbrey et al.
5,524,637 A 6/1996 Erickson et al.
5,534,917 A 7/1996 MacDougall
5,563,988 A 10/1996 Maes et al.
5,577,981 A 11/1996 Jarvik
5,580,249 A 12/1996 Jacobsen et al.
5,594,469 A 1/1997 Freeman et al.
5,597,309 A 1/1997 Riess
5,616,078 A 4/1997 Oh
5,617,312 A 4/1997 Iura et al.
5,638,300 A 6/1997 Johnson
5,641,288 A 6/1997 Zaenglein
5,682,196 A 10/1997 Freeman
5,682,229 A 10/1997 Wangler
5,690,582 A 11/1997 Ulrich et al.
5,703,367 A 12/1997 Hashimoto et al.
5,704,837 A 1/1998 Iwasaki et al.
5,715,834 A 2/1998 Bergamasco et al.
5,875,108 A 2/1999 Hoffberg et al.
5,877,803 A 3/1999 Wee et al.
5,913,727 A 6/1999 Ahdoot
5,933,125 A 8/1999 Fernie
5,980,256 A 11/1999 Carmein
5,989,157 A 11/1999 Walton
5,995,649 A 11/1999 Marugame
6,005,548 A 12/1999 Latypov et al.
6,009,210 A 12/1999 Kang
6,018,118 A 1/2000 Smith et al.
6,054,991 A 4/2000 Crane et al.
6,066,075 A 5/2000 Poulton
6,072,494 A 6/2000 Nguyen
6,073,489 A 6/2000 French et al.
6,077,201 A 6/2000 Cheng et al.
6,098,458 A 8/2000 French et al.
6,100,896 A 8/2000 Strohecker et al.
6,101,289 A 8/2000 Kellner
6,128,003 A 10/2000 Smith et al.
6,130,677 A 10/2000 Kunz
6,141,463 A 10/2000 Covell et al.
6,147,678 A 11/2000 Kumar et al.
6,152,856 A 11/2000 Studor et al.
6,159,100 A 12/2000 Smith
6,173,066 B1 1/2001 Peurach et al.
6,181,343 B1 1/2001 Lyons
6,188,777 B1 2/2001 Darrell et al.
6,215,890 B1 4/2001 Matsuo et al.
6,215,898 B1 4/2001 Woodfill et al.
6,226,396 B1 5/2001 Marugame
6,229,913 B1 5/2001 Nayar et al.
6,256,033 B1 7/2001 Nguyen
6,256,400 B1 7/2001 Takata et al.
6,283,860 B1 9/2001 Lyons et al.
6,289,112 B1 9/2001 Jain et al.
6,299,308 B1 10/2001 Voronka et al.
6,308,565 B1 10/2001 French et al.
6,316,934 B1 11/2001 Amorai-Moriya et al.
6,363,160 B1 3/2002 Bradski et al.
6,384,819 B1 5/2002 Hunter
6,411,744 B1 6/2002 Edwards
6,430,997 B1 8/2002 French et al.
6,476,834 B1 11/2002 Doval et al.
6,496,598 B1 12/2002 Harman
6,503,195 B1 1/2003 Keller et al.
6,506,969 B1 * 1/2003 Baron ..... 84/609
6,539,931 B2 4/2003 Trajkovic et al.
6,570,555 B1 5/2003 Prevost et al.
6,633,294 B1 10/2003 Rosenthal et al.
6,640,202 B1 10/2003 Dietz et al.
6,661,918 B1 12/2003 Gordon et al.
6,681,031 B2 1/2004 Cohen et al.
6,714,665 B1 3/2004 Hanna et al.
6,731,799 B1 5/2004 Sun et al.
6,738,066 B1 5/2004 Nguyen
6,765,726 B2 7/2004 French et al.
6,788,809 B1 9/2004 Grzeszczuk et al.
6,801,637 B2 10/2004 Voronka et al.
6,873,723 B1 3/2005 Aucsmith et al.
6,876,496 B2 4/2005 French et al.
6,937,742 B2 8/2005 Roberts et al.
6,950,534 B2 9/2005 Cohen et al.
7,003,134 B1 2/2006 Covell et al.
7,036,094 B1 4/2006 Cohen et al.
7,038,855 B2 5/2006 French et al.
7,039,676 B1 5/2006 Day et al.
7,042,440 B2 5/2006 Pryor et al.
7,050,606 B2 5/2006 Paul et al.
7,058,204 B2 6/2006 Hildreth et al.
7,060,957 B2 6/2006 Lange et al.
7,113,918 B1 9/2006 Ahmad et al.
7,121,946 B2 10/2006 Paul et al.
7,170,492 B2 1/2007 Bell
7,184,048 B2 2/2007 Hunter
7,202,898 B1 4/2007 Braun et al.
7,222,078 B2 5/2007 Abelow
7,227,526 B2 6/2007 Hildreth et al.
7,259,747 B2 8/2007 Bell
7,308,112 B2 12/2007 Fujimura et al.
7,317,836 B2 1/2008 Fujimura et al.
7,348,963 B2 3/2008 Bell
7,359,121 B2 4/2008 French et al.
7,367,887 B2 5/2008 Watabe et al.
7,379,563 B2 5/2008 Shamaie
7,379,566 B2 5/2008 Hildreth
7,389,591 B2 6/2008 Jaiswal et al.
7,402,743 B2 7/2008 Clark et al.
7,412,077 B2 8/2008 Li et al.
7,421,093 B2 9/2008 Hildreth et al.
7,430,312 B2 9/2008 Gu
7,436,496 B2 10/2008 Kawahito
7,450,736 B2 11/2008 Yang et al.
7,452,275 B2 11/2008 Kuraishi
7,460,690 B2 12/2008 Cohen et al.
7,489,812 B2 2/2009 Fox et al.
7,536,032 B2 5/2009 Bell
7,555,142 B2 6/2009 Hildreth et al.
7,560,701 B2 7/2009 Oggier et al.
7,570,805 B2 8/2009 Gu
7,574,020 B2 8/2009 Shamaie
7,576,727 B2 8/2009 Bell
7,590,262 B2 9/2009 Fujimura et al.
7,593,552 B2 9/2009 Higaki et al.
7,598,942 B2 10/2009 Underkoffler et al.
7,607,509 B2 10/2009 Schmiz et al.
7,620,202 B2 11/2009 Fujimura et al.
7,668,340 B2 2/2010 Cohen et al.
7,680,298 B2 3/2010 Roberts et al.
7,683,954 B2 3/2010 Ichikawa et al.
7,684,592 B2 3/2010 Paul et al.
7,701,439 B2 4/2010 Hillis et al.
7,702,130 B2 4/2010 Im et al.
7,704,135 B2 4/2010 Harrison, Jr.
7,710,391 B2 5/2010 Bell et al.
7,729,530 B2 6/2010 Antonov et al.
7,746,345 B2 6/2010 Hunter
7,754,955 B2 * 7/2010 Egan ..... 84/600
7,760,182 B2 7/2010 Ahmad et al.
7,809,167 B2 10/2010 Bell

(56) References Cited

U.S. PATENT DOCUMENTS

| | | | | |
|---|---|---|---|---|
| 7,834,846 | B1 | 11/2010 | Bell | |
| 7,852,262 | B2 | 12/2010 | Namineni et al. | |
| RE42,256 | E | 3/2011 | Edwards | |
| 7,898,522 | B2 | 3/2011 | Hildreth et al. | |
| 7,989,689 | B2 * | 8/2011 | Sitrick et al. | 84/723 |
| 8,035,612 | B2 | 10/2011 | Bell et al. | |
| 8,035,614 | B2 | 10/2011 | Bell et al. | |
| 8,035,624 | B2 | 10/2011 | Bell et al. | |
| 8,072,470 | B2 | 12/2011 | Marks | |
| 2003/0159567 | A1 * | 8/2003 | Subotnick | 84/626 |
| 2004/0118268 | A1 | 6/2004 | Ludwig | |
| 2008/0026838 | A1 | 1/2008 | Dunstan et al. | |
| 2009/0288548 | A1 | 11/2009 | Murphy et al. | |
| 2010/0206157 | A1 | 8/2010 | Glaser | |

FOREIGN PATENT DOCUMENTS

| | | | |
|---|---|---|---|
| JP | 08044490 | A1 | 2/1996 |
| WO | 93/10708 | A1 | 6/1993 |
| WO | 97/17598 | A1 | 5/1997 |
| WO | 99/44698 | A1 | 9/1999 |
| WO | 2009007512 | A1 | 1/2009 |
| WO | 2009127462 | A1 | 10/2009 |

OTHER PUBLICATIONS

Coxworth, Ben, "Microsoft motion controller to hit stores as Kinect for Xbox 360", Retrieved at << http://www.gizmag.com/microsoft-kinect-for-xbox-360/15415/ >>, Jun. 15, 2010, pp. 5.
"Kinect", Retrieved at << http://www.afterdawn.com/glossary/term.cfm/kinect >>, Aug. 10, 2010, pp. 14.
"Laser harp", Retrieved at << http://en.wikipedia.org/wiki/Laser_harp >>, Retrieved date: Oct. 8, 2010, pp. 5.
"New High-Tech Musical Instruments" Retrieved at << http://www.rogerlinndesign.com/other/new_instruments/ >>, pp. 5, Jan. 13, 2011.
Kanade et al., "A Stereo Machine for Video-rate Dense Depth Mapping and Its New Applications", IEEE Computer Society Conference on Computer Vision and Pattern Recognition, Jun. 18-20, 1996, pp. 196-202,The Robotics Institute, Carnegie Mellon University, Pittsburgh, PA.
Miyagawa et al., "CCD-Based Range Finding Sensor", Oct. 1997, pp. 1648-1652, vol. 44 No. 10, IEEE Transactions on Electron Devices.
Rosenhahn et al., "Automatic Human Model Generation", Sep. 5-8, 2005, pp. 41-48, University of Auckland (CITR), New Zealand.
Aggarwal et al., "Human Motion Analysis: A Review", IEEE Nonrigid and Articulated Motion Workshop, Jun. 1997, University of Texas at Austin, Austin, TX.
Shao et al., "An Open System Architecture for a Multimedia and Multimodal User Interface", Aug. 24, 1998, Japanese Society for Rehabilitation of Persons with Disabilities (JSRPD), Japan.
Kohler, "Special Topics of Gesture Recognition Applied in Intelligent Home Environments", In Proceedings of the Gesture Workshop, Sep. 17-19, 1997, pp. 285-296, Germany.
Kohler, "Vision Based Remote Control in Intelligent Home Environments", University of Erlangen-Nuremberg/ Germany, 1996, pp. 147-154, Germany.
Kohler, "Technical Details and Ergonomical Aspects of Gesture Recognition applied in Intelligent Home Environments", 1997, Germany.
Hasegawa et al., "Human-Scale Haptic Interaction with a Reactive Virtual Human in a Real-Time Physics Simulator", Jul. 2006, vol. 4, No. 3, Article 6C, ACM Computers in Entertainment, New York, NY.
Qian et al., "A Gesture-Driven Multimodal Interactive Dance System", Jun. 2004, pp. 1579-1582, IEEE International Conference on Multimedia and Expo (ICME), Taipei, Taiwan.
Zhao, "Dressed Human Modeling, Detection, and Parts Localization", Jun. 26, 2001, The Robotics Institute, Carnegie Mellon University, Pittsburgh, PA.
He, "Generation of Human Body Models", Apr. 2005, University of Auckland, New Zealand.
Isard et al., "Condensation—Conditional Density Propagation for Visual Tracking", Aug. 1998, pp. 5-28, International Journal of Computer Vision 29(1), Netherlands.
Livingston, "Vision-based Tracking with Dynamic Structured Light for Video See-through Augmented Reality", Oct. 1998, University of North Carolina at Chapel Hill, North Carolina, USA.
Wren et al., "Pfinder: Real-Time Tracking of the Human Body", MIT Media Laboratory Perceptual Computing Section Technical Report No. 353, Jul. 1997, vol. 19, No. 7, pp. 780-785, IEEE Transactions on Pattern Analysis and Machine Intelligence, Caimbridge, MA.
Breen et al., "Interactive Occlusion and Collusion of Real and Virtual Objects in Augmented Reality", Technical Report ECRC-95-02, 1995, European Computer-Industry Research Center GmbH, Munich, Germany.
Freeman et al., "Television Control by Hand Gestures", Dec. 1994, Mitsubishi Electric Research Laboratories, TR94-24, Caimbridge, MA.
Hongo et al., "Focus of Attention for Face and Hand Gesture Recognition Using Multiple Cameras", Mar. 2000, pp. 156-161, 4th IEEE International Conference on Automatic Face and Gesture Recognition, Grenoble, France.
Pavlovic et al., "Visual Interpretation of Hand Gestures for Human-Computer Interaction: A Review", Jul. 1997, pp. 677-695, vol. 19, No. 7, IEEE Transactions on Pattern Analysis and Machine Intelligence.
Azarbayejani et al., "Visually Controlled Graphics", Jun. 1993, vol. 15, No. 6, IEEE Transactions on Pattern Analysis and Machine Intelligence.
Granieri et al., "Simulating Humans in VR", The British Computer Society, Oct. 1994, Academic Press.
Brogan et al., "Dynamically Simulated Characters in Virtual Environments", Sep./Oct. 1998, pp. 2-13, vol. 18, Issue 5, IEEE Computer Graphics and Applications.
Fisher et al., "Virtual Environment Display System", ACM Workshop on Interactive 3D Graphics, Oct. 1986, Chapel Hill, NC.
"Virtual High Anxiety", Tech Update, Aug. 1995, pp. 22.
Sheridan et al., "Virtual Reality Check", Technology Review, Oct. 1993, pp. 22-28, vol. 96, No. 7.
Stevens, "Flights into Virtual Reality Treating Real-World Disorders", The Washington Post, Mar. 27, 1995, Science Psychology, 2 Pages.
"Simulation and Training", 1994, Division Incorporated, pp. 1-6.

* cited by examiner

FREE-SPACE GESTURE MUSICAL INSTRUMENT DIGITAL INTERFACE (MIDI) CONTROLLER

BACKGROUND

The creativity of musicians is enhanced through new musical instruments. Low-cost mass-market computing has brought an explosion of new musical creativity through electronic and computerized instruments. The human-computer interface with such instruments is key. The widely accepted Musical Instrument Digital Interface (MIDI) standard provides a common way for various electronic instruments to be controlled by a variety of human interfaces.

MIDI is a standard protocol that allows electronic musical instruments, computers and other electronic devices to communicate and synchronize with each other. MIDI does not transmit an audio signal. Instead it sends event messages about pitch and intensity, control signals for parameters such as volume, vibrato and panning, and clock signals in order to set a tempo. MIDI is an electronic protocol that has been recognized as a standard in the music industry since the 1980s.

All MIDI compatible controllers, musical instruments and MIDI compatible software follow the standard MIDI specification and interpret any MIDI message in the same way. If a note is played on a MIDI controller, it will sound the right pitch on any MIDI-capable instrument.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The free-space gesture MIDI controller technique described herein marries the technologies embodied in a free-space gesture controller with MIDI controller technology, allowing one or more users to control an infinite variety of electronic musical instruments through body gesture and pose.

The technique provides a means for a free-space gesture controller connected to a computing device (for example, a game console) to output standard MIDI control signals. In general, in one embodiment of the technique, this is done through a MIDI hardware interface between signals of the computing device and the MIDI-capable instrument or instruments. Alternately, a MIDI hardware interface between the free-space gesture controller device and a MIDI-capable instrument can be employed, if the free-space gesture controller has enough computing power to compute the necessary computations to convert the gestures to MIDI control signals. A mapping between user gestures and MIDI control elements (e.g., a map of a particular limb gesture to a particular MIDI control parameter) is used to convert captured user gestures into MIDI control commands. These MIDI control commands are then sent to any MIDI-capable instrument or device in order to play or operate the instrument or device.

More particularly, in one embodiment, the technique uses free-space gesture recognition to control a MIDI-capable electronic musical instrument as follows. Free-space gestures of one or more human beings simulating playing an electronic musical instrument are captured and recorded. Each free-space gesture of each human being is converted to a standard MIDI control signal for a standard MIDI-capable musical instrument using a predetermined mapping of user gestures to MIDI control signals representing specific notes, a chord, a sequence or transport control of a music sample. The mapped MIDI control signals are then used to play the one or more standard MIDI-capable musical instruments.

DESCRIPTION OF THE DRAWINGS

The specific features, aspects, and advantages of the disclosure will become better understood with regard to the following description, appended claims, and accompanying drawings where:

DETAILED DESCRIPTION

Figure 1:
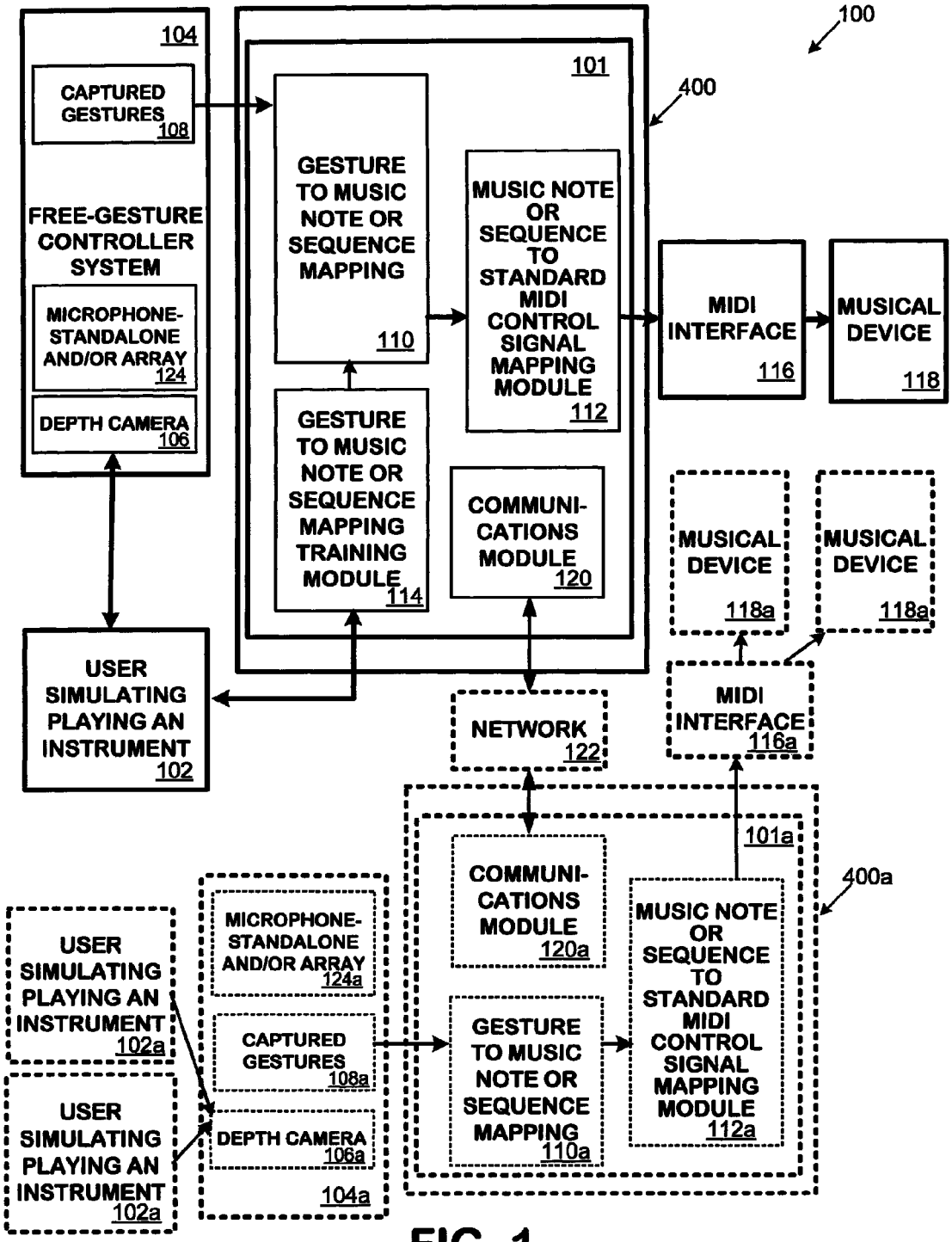
FIG. 1 depicts a schematic of an exemplary architecture for employing one embodiment of the free-space gesture MIDI controller technique.

In the following description of the free-space gesture MIDI controller technique, reference is made to the accompanying drawings, which form a part thereof, and which show by way of illustration examples by which the free-space gesture MIDI controller technique described herein may be practiced. It is to be understood that other embodiments may be utilized and structural changes may be made without departing from the scope of the claimed subject matter.

1.0 Free-Space Gesture MIDI Controller Technique

The following sections provide background information, an overview of the free-space gesture MIDI controller technique, as well as an exemplary architecture and exemplary processes for practicing the technique.

1.1 Background

It is nearly pervasive practice for electronic musical instruments to be controlled using the MIDI standard protocol which allows separation of the sound-generating engine from the device that the human player uses to control that engine. The most common device used by humans to control sound generation over MIDI today is the electronic piano-style keyboard. This comes in a variety of established sizes, but all are "piano-like" in general style and appearance. Less common controllers include a guitar-style controller (usually a normal guitar augmented with additional components to convert conventional player actions into MIDI signals), and a breath controller (which similarly uses conventional player actions of instruments such as a clarinet or saxophone, but in this case, typically does not use the conventional instrument as a base but instead uses a purpose-built device that outputs MIDI signals and only superficially is fashioned after a conventional instrument). A variety of other unique MIDI controllers exist, including one-off examples such as a laser harp.

1.2 Overview of the Technique

One embodiment of the free-space gesture MIDI controller technique described herein uses a human body gesture recognition capability of a free-space gesture controller or control system (such as, for example, Microsoft® Corporation's Kinect™ controller that is typically used as a controller for a gaming system) and translates human gestures into musical actions. Rather than directly connecting a specific musical instrument to the free-space gesture controller, the technique generalizes its capability and instead outputs standard MIDI signals, thereby allowing the free-space gesture control system to control any MIDI-capable instrument. For purposes of this disclosure, a MIDI-capable instrument can be any device that can understand MIDI-commands.

One such free-space gesture controller or control system that can be employed with the technique has a depth camera that helps to interpret a scene playing out in front of it. Together with software running on a computing device (e.g., such as, for example, a gaming console such as, for example, Microsoft® Corporation's Xbox 360®), the free-space gesture control system can interpret the scene captured by the depth camera to determine and recognize specific gestures being made by the human in front of the device. These gestures can be mapped to specific meanings to corresponding notes, chords, sequences, transport controls, and the like.

In one embodiment of the technique, either a human must specify the mapping a priori, or at least be aware that a mapping exists. The mapping is usually preferably consistent—i.e., the same gesture performed at different times results in the same meaning. The gesture meanings could include such acts as playing a specific note, a chord, a sequence, or transport control of a music sample. Note that it is common today for musicians to not play notes one by one, or chord by chord, but through the creative control of a sample of pre-existing music often called a "loop". Some users may want specific editorial control over the mapping and one embodiment of the technique allows editing of the mapping of the gestures to the corresponding notes, chords, sequences, and transport controls.

In one embodiment of the technique in order to generate the MIDI signals from the free-space gesture control system, or from a free-space gesture controller and associated computing device, a standard physical MIDI interface is employed (e.g., DIN socket for MIDI OUT). A MIDI interface box is plugged into an existing free-space gesture controller or free-space gesture controller/computing device combination, from which the MIDI signals emerge. Thus, free-space gesture control system signals are converted to MIDI control signals.

The free-space gesture controller system used standalone, or free-space gesture control system/computing device combination, converts captured gestures to free-space gesture control signals, and then those free-space gesture control signals are mapped to the MIDI signals/electronics using the free-space gesture MIDI control technique. In one embodiment, MIDI signals are output over a USB interface. This then allows standard USB-MIDI hardware to be used, which is widely available.

In one embodiment of the technique, the mapping of gestures to MIDI signals can either be fixed, or can be editable by the end user to allocate certain gestures to certain control meanings.

There are various variations to the embodiments discussed above. For example, since some free-space gesture control systems have the ability to record sound. One embodiment of the technique uses this recorded sound it to supplement the control signals with audio signals. For example, audio of a user who is singing, or playing a conventional acoustic instrument (or both) is captured and mixed with real instrument control. Additionally, another embodiment of the technique allows for the attachment of a hand-held microphone or other auxiliary microphones to better capture this supplemental audio signal.

In another embodiment of the free-space gesture MIDI control technique, local multi-party playing of electronic instruments is supported. For example, some free-space gesture controllers have the capability to capture gestures from multiple humans in a room. This functionality can be employed by the technique to allow multiple players to each play an instrument, or to allow multiple players to play the same single instrument (e.g., a keyboard for example).

In one embodiment of the technique, remote multi-party playing of electronic instruments is supported. For example, some free-space gesture controllers have real-time remote communications capability. One embodiment of the technique uses this capability to allow remote players to combine their gesturing to create music over distance via a network in a new shared social experience.

1.3 Exemplary Architecture

FIG. 1 depicts an exemplary architecture 100 for employing one embodiment of the free-space gesture MIDI controller technique described herein.

As shown in FIG. 1, gestures of a user 102 simulating playing a musical instrument are captured using a free-space gesture control system 104 which employs a depth camera 106. In one embodiment of the technique, a gesture capturing module 108 of the free-space gesture control system 104 captures and interprets gestures of the user with the depth camera 106 by transmitting encoded information on infrared light patterns in a space where the human being 102 is gesturing and then capturing changes to the encoded infrared light patterns with the depth camera 106 to determine which gestures the human being 102 is making. The captured gestures are sent to a free-space gesture to MIDI mapping module 101 that resides on a computing device 400 which will be explained in greater detail with respect to FIG. 4.

In one embodiment, in order to determine a mapping 110 between gestures captured and standard control signal for making a given musical note, chord, sequence, transport control, and the like, a training module 114 is employed. More specifically, each gesture captured is mapped to a standard control signal for operating a musical device so as to associate certain gestures with a standard control signal to make a musical sequence or note. In one embodiment, the training module 114 prompts a human being 102 to make a gesture representing a musical note or sequence. The gesture made by the prompted human being is then recorded and associated with a corresponding control signal for making that particular musical note or sequence.

Once the mapping 110 has been created, each gesture by the user simulating playing an instrument 102 is mapped to the standard control signal (e.g., a MIDI control signal) for operating an electronic musical device to create the corresponding notes, sequences, and so forth. The mapping 110 is used to translate each captured gesture 108 into a standard MIDI control signal in a MIDI mapping module 112. These standard MIDI control signals are output to a standard MIDI hardware interface 116 that sends the signal to any MIDI-capable musical instrument 118 (or other MIDI-capable device) that creates the sounds (or executes commands) that correspond to the users' gesturing.

In one embodiment of the technique, the computing device 400 which converts the gestures to MIDI signals can also be equipped with a communications module 120 which communicates with at least one other computing device 400*a* over a network 122. This at least one other computing device 400*a* is also equipped with a free-space gesture control system 104*a* and a gesture mapping catalog 110*a* and a MIDI control signal mapping module 112*a*. One or more users 102*a*, 102*b* can create gestures simulating the playing of the same or different instruments which are recorded using the free-space gesture control system 108*a* and converted to MIDI control signals using the gesture mapping catalog 110*a* and the MIDI control signal mapping module 112*a*. These standard MIDI control signals are output to a standard MIDI hardware interface 116*a* that sends the signal to MIDI-capable musical instrument 118*a*, 118*b* that create the sounds that correspond to the users' 102*a*, 102*b* gesturing. These control signals can also be sent to the free-space gesture MIDI controller 100 over the network 118 and be simultaneously played at the location of the free-space gesture controller.

It should be noted that the free-space gesture controller system 104 can also include one or more microphones 122 to capture audio at the location of the user 102 simulating playing an instrument. In fact, in one embodiment a microphone array is used to assist in providing sound source localization and therefore the location of the user (or users if there is more than one).

An exemplary architecture for practicing the technique having been described, the next section discusses some exemplary processes for practicing the technique.

Figure 2:
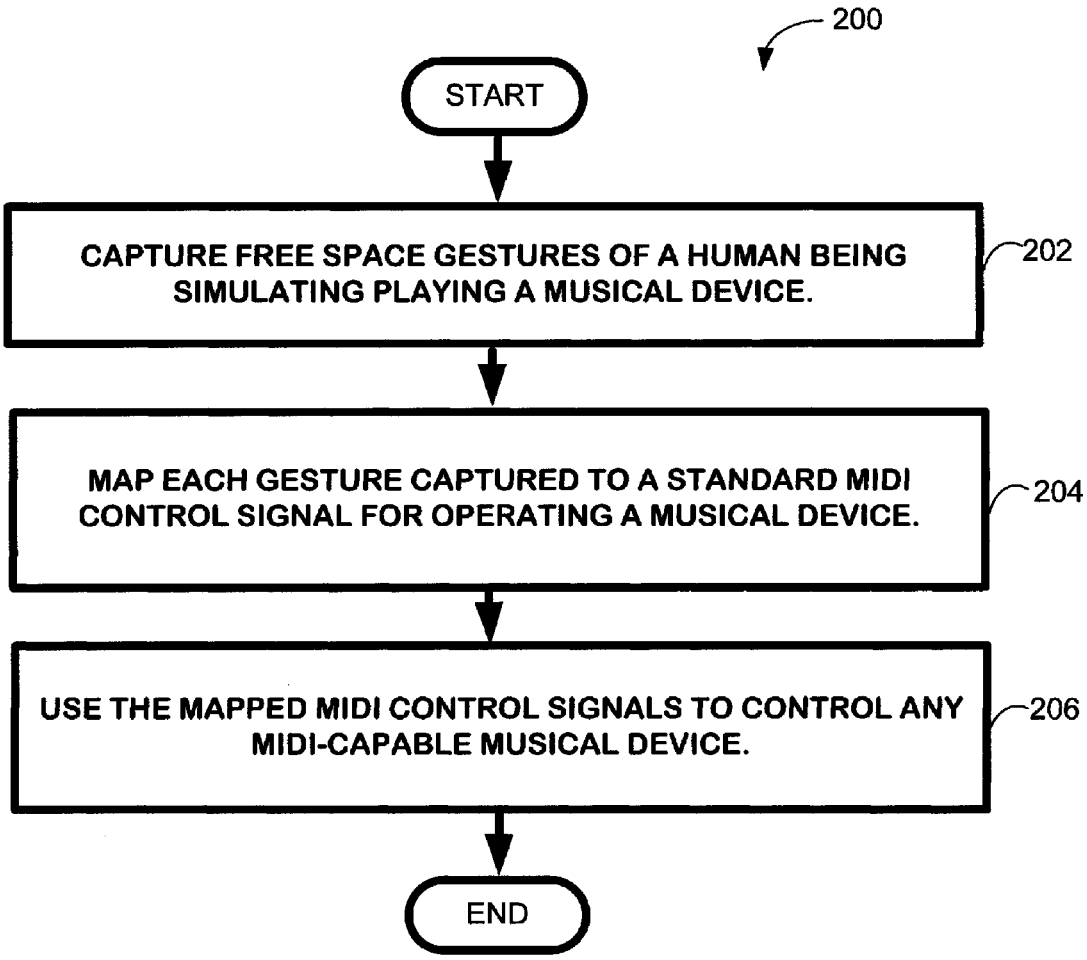
FIG. 2 depicts a flow diagram of an exemplary process for practicing one embodiment of the free-space gesture MIDI controller.
Figure 3:
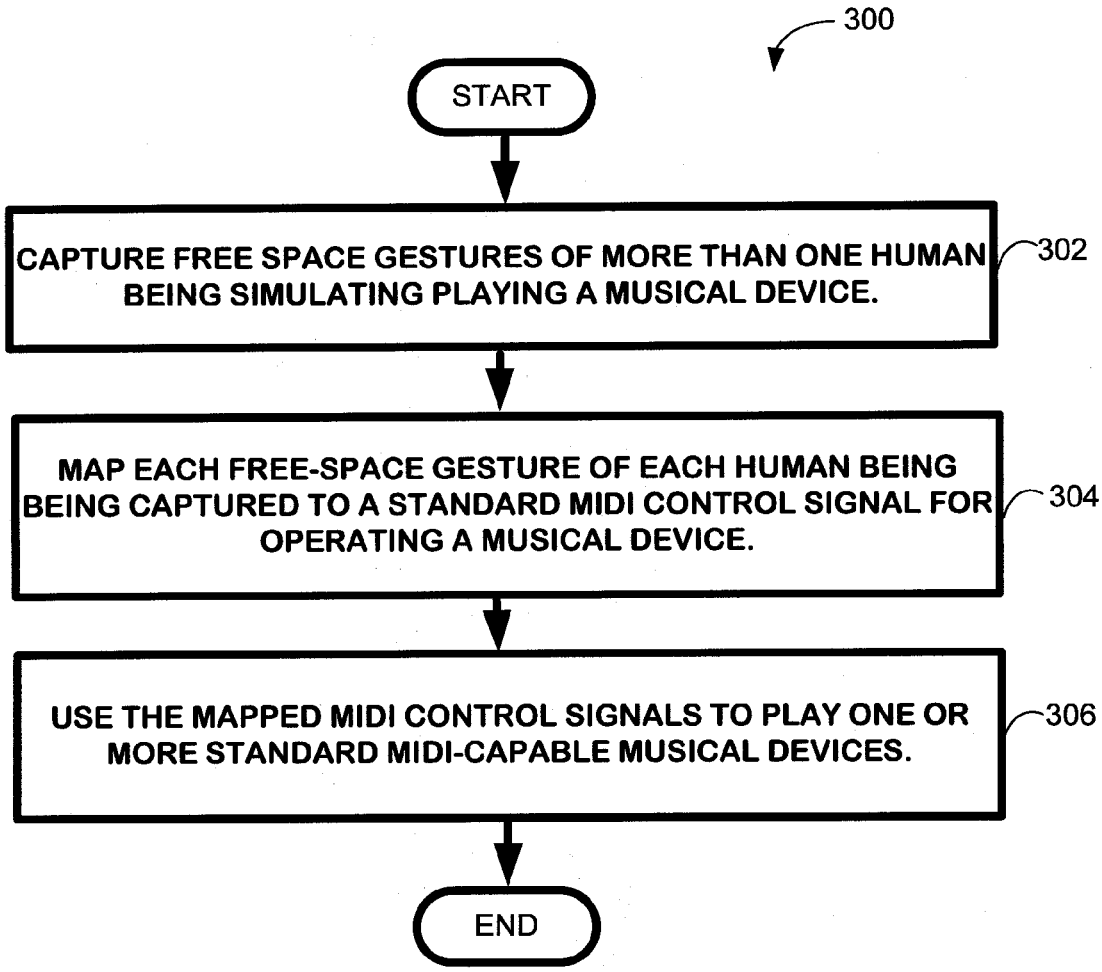
FIG. 3 depicts a flow diagram of another exemplary process for practicing another embodiment of the free-space gesture MIDI controller technique.

1.4 Exemplary Processes for Employing the Free-Space Gesture MIDI Controller Technique FIGS. 2 and 3 and the following paragraphs provide descriptions of exemplary processes 200, 300 for practicing the free-space gesture MIDI controller technique described herein. It should be understood that in some cases the order of actions can be interchanged, and in some cases some of the actions may even be omitted.

FIG. 2 provides a flow diagram of an exemplary process 200 for using free-space gesture recognition to control a MIDI-capable musical device, such as for example a musical instrument, synthesizer, and so forth, according to one embodiment of the technique. As shown in block 202, free-space gestures of a human being (user) simulating playing a musical device are captured. For example, the gesture can be captured using a depth camera in a free-space gesture controller. Additionally, the audio of the user (vocal or audio from another instrument) and any additional human beings present can also be captured. For instance, this may occur when the user is vocalizing or playing (even simultaneously) an acoustic or another electronic instrument in the same room. Additionally, the audio can be captured by a microphone array that can also perform sound source localization.

Each gesture captured is mapped to a standard MIDI control signal for operating the electronic device, as shown in block 204. For example, each gesture captured can be mapped to a standard MIDI control signal using a game console or other computing device. In one embodiment of the technique the mapping of each gesture to a standard MIDI control signal is fixed based on a pre-set gesture ontology. In an alternate embodiment, the mapping of each gesture to a standard MIDI control signal is editable by a user to allocate certain gestures to certain control signal meanings.

The mapped MIDI control signals are used to control a MIDI-capable electronic device, as shown in block 206. It should be noted that any MIDI-capable electronic device can be controlled with the mapped gestures without requiring changes to the mapping.

The technique can also capture the gestures of at least one additional human being playing at least one additional electronic instrument. As above, each gesture captured made by each additional human being is mapped to a standard MIDI control signal for operating each additional electronic instrument. The mapped MIDI control signals are then used to control each of the additional MIDI-capable electronic instruments.

FIG. 3 depicts a flow diagram for another computer-implemented process for using free-space gesture recognition to control a MIDI-capable electronic musical instrument. In this embodiment, free-space gestures of more than one human simulating playing an electronic musical instrument are captured, as shown in block 302. Each free-space gesture of each human being captured is mapped to a standard MIDI control signal for a standard MIDI-capable musical instrument, as shown in block 304. As discussed previously, in one embodiment of the technique the mapping of each gesture to a standard MIDI control signal is fixed. In an alternate embodiment, the mapping of each gesture to a standard MIDI control signal is editable by a user to allocate certain gestures to certain control signal meanings.

The mapped MIDI control signals are then used to play the one or more standard MIDI-capable musical instruments, as shown in block 306.

In one embodiment of the technique, each of the one or more human beings playing an electronic musical instrument using the captured gestures are located in a different location and the audio of at least one human being playing an electronic musical instrument at a first location is transmitted to the location of at least one other human being playing an electronic musical instrument over a network. In addition, video of one human being playing an electronic musical instrument at the first location can be sent to the location of at least one other human being playing an electronic musical instrument over a network.

2.0 The Computing Environment

The free-space gesture MIDI controller technique is designed to operate in a computing environment. The following description is intended to provide a brief, general description of a suitable computing environment in which the free-space gesture MIDI controller technique can be implemented. The technique is operational with numerous general purpose or special purpose computing system environments or configurations. Examples of well-known computing systems, environments, and/or configurations that may be suitable include, but are not limited to, personal computers, server computers, hand-held or laptop devices (for example, media players, notebook computers, cellular phones, personal data assistants, voice recorders), multiprocessor systems, microprocessor-based systems, set top boxes, programmable consumer electronics, network PCs, minicomputers, mainframe computers, distributed computing environments that include any of the above systems or devices, and the like.

Figure 4:
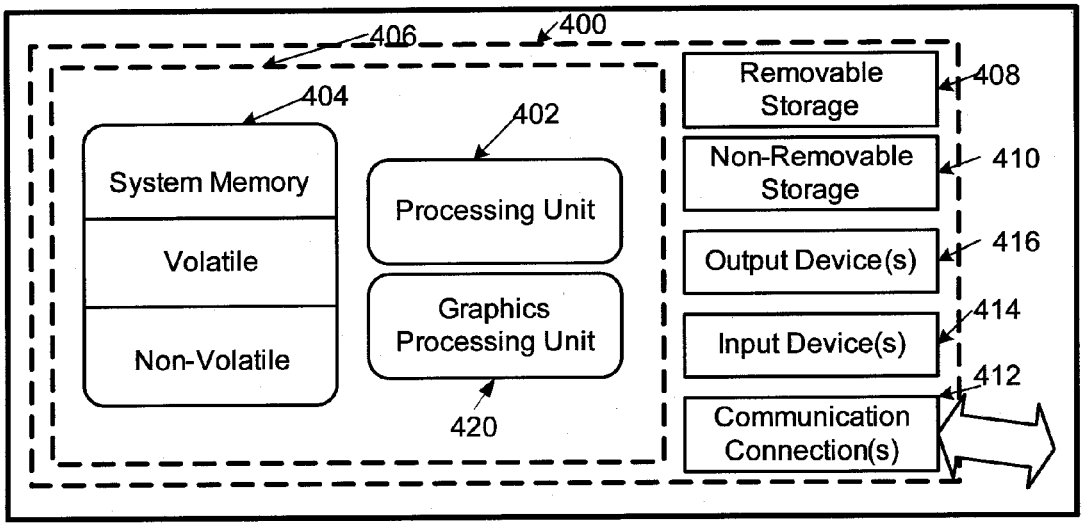
FIG. 4 is a schematic of an exemplary computing device which can be used to practice the free-space gesture MIDI controller technique.

FIG. 4 illustrates an example of a suitable computing system environment. The computing system environment is only one example of a suitable computing environment and is not intended to suggest any limitation as to the scope of use or functionality of the present technique. Neither should the computing environment be interpreted as having any dependency or requirement relating to any one or combination of components illustrated in the exemplary operating environment. With reference to FIG. 4, an exemplary system for implementing the free-space gesture MIDI controller technique includes a computing device, such as computing device 400. In its most basic configuration, computing device 400 typically includes at least one processing unit 402 and memory 404. Depending on the exact configuration and type of computing device, memory 404 may be volatile (such as RAM), non-volatile (such as ROM, flash memory, etc.) or some combination of the two. This most basic configuration is illustrated in FIG. 4 by dashed line 406. Additionally, device 400 may also have additional features/functionality. For example, device 400 may also include additional storage (removable and/or non-removable) including, but not limited to, magnetic or optical disks or tape. Such additional storage is illustrated in FIG. 4 by removable storage 408 and non-removable storage 410. Computer storage media includes volatile and nonvolatile, removable and non-removable media implemented in any method or technology for storage of information such as computer readable instructions, data structures, program modules or other data. Memory 404, removable storage 408 and non-removable storage 410 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by device 400. Computer readable media include both transitory, propagating signals and computer (readable) storage media. Any such computer storage media may be part of device 400.

Device 400 also can contain communications connection (s) 412 that allow the device to communicate with other devices and networks. Communications connection(s) 412 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal, thereby changing the configuration or state of the receiving device of the signal. By way of example, and not limitation, communication media includes wired media such as a wired network or direct-wired connection, and wireless media such as acoustic, RF, infrared and other wireless media. The term computer readable media as used herein includes both storage media and communication media.

Device 400 may have various input device(s) 414 such as a display, keyboard, mouse, pen, camera, touch input device, and so on. Output device(s) 416 devices such as a display, speakers, a printer, and so on may also be included. All of these devices are well known in the art and need not be discussed at length here.

The free-space gesture MIDI controller technique may be described in the general context of computer-executable instructions, such as program modules, being executed by a computing device. Generally, program modules include routines, programs, objects, components, data structures, and so on, that perform particular tasks or implement particular abstract data types. The free-space gesture MIDI controller technique may be practiced in distributed computing environments where tasks are performed by remote processing devices that are linked through a communications network. In a distributed computing environment, program modules may be located in both local and remote computer storage media including memory storage devices. Still further, the aforementioned instructions could be implemented, in part or in whole, as hardware logic circuits, which may or may not include a processor.

It should also be noted that any or all of the aforementioned alternate embodiments described herein may be used in any combination desired to form additional hybrid embodiments. Although the subject matter has been described in language specific to structural features and/or methodological acts, it is to be understood that the subject matter defined in the appended claims is not necessarily limited to the specific features or acts described above. The specific features and acts described above are disclosed as example forms of implementing the claims.

What is claimed is:

1. A computer-implemented process for using free-space gesture recognition to control a MIDI-capable electronic device, comprising:

using a depth camera, capturing free-space gestures of a first human being simulating playing a musical device;

mapping each gesture captured to a standard MIDI control signal for operating the musical device;

capturing audio of the first human being, or vocal or audio from another instrument, and any additional human beings present;

using the mapped MIDI control signals to control a MIDI-capable musical device while playing back the captured audio.

2. The computer-implemented process of claim 1 wherein the mapping further comprises:

mapping each gesture captured to a standard MIDI control signal using a game console.

3. The computer-implemented process of claim 1 wherein the mapping further comprises:

mapping each gesture captured to a standard MIDI control signal using a computing device.

4. The computer-implemented process of claim 1 wherein the audio is captured by a microphone array that can also perform sound source localization.

5. The computer-implemented process of claim 1 wherein the MIDI-capable electronic device that can be controlled using the mapped MIDI control signals is a musical instrument.

6. The computer-implemented process of claim 1, further comprising:

capturing gestures of at least one additional human being playing at least one additional electronic device;

mapping each gesture captured by the at least one additional human being to a standard MIDI control signal for operating each of the at least one additional electronic device;

using the mapped MIDI control signals to control each of the at least one additional MIDI-capable electronic device.

7. The computer-implemented process of claim 1 wherein at least one of the additional human beings are at a different location of the first human being.

8. The computer-implemented process of claim 1 wherein any MIDI-capable electronic device can be controlled with the mapped gestures.

9. The computer-implemented process of claim 1 wherein the mapping of each gesture to a standard MIDI control signal is fixed to a certain control signal meaning.

10. The computer-implemented process of claim 1 wherein the mapping of each gesture to a standard MIDI control signal is editable by a user to allocate certain gestures to certain control signal meanings.

11. A computer-implemented process for using free-space gesture recognition to control a MIDI-capable electronic musical instrument, comprising:

using one or more depth cameras, capturing free-space gestures of more than one human simulating playing an electronic musical instrument, each of the one or more human beings simulating playing an electronic musical instrument using the captured gestures in a different location;

mapping each free-space gesture of each human being captured to a standard MIDI control signal for a standard MIDI-capable musical instrument;

using the mapped MIDI control signals to play the one or more standard MIDI-capable musical instruments;

sending audio of at least one human being playing an electronic musical instrument at a first location to the location of at least one other human being playing an electronic musical instrument over a network; and playing the sent audio with the at least one other human being playing the electronic musical instrument.

12. The computer-implemented process of claim 11 wherein the mapping of each free-space gesture to a standard MIDI control signal is fixed.

13. The computer-implemented process of claim 11 wherein the mapping of each gesture to a standard MIDI control signal is editable by a user to allocate certain gestures to certain control signal meanings.

14. The computer-implemented process of claim 11, further comprising:

sending video of one or more human beings playing an electronic musical instrument at the first location to the location of at least one other human being playing an electronic musical instrument over a network.

15. A system for playing a musical device using gestures, comprising:

a general purpose computing device;

a computer program comprising program modules executable by the general purpose computing device, wherein the computing device is directed by the program modules of the computer program to, capture gestures of a human being simulating playing an electronic musical device using a depth camera, wherein the module to capture gestures further comprises submodules to:

transmit encoded information on infrared light patterns in a space where the human being is gesturing; and capture changes to the encoded infrared light patterns with the depth camera to determine which gestures the human being is making;

map each gesture captured to a standard control signal for operating an electronic musical device;

use the mapped control signals to play an electronic musical device; and capture audio of the human being, or vocal or audio from another instrument along with audio from the electronic musical device played using the mapped control signals.

16. The system of claim 15, wherein the module to map each gesture captured to a standard control signal for operating the musical device further comprising modules to:

prompt a human being to make a gesture representing a musical note or sequence;

record a gesture made by the prompted human being; and map the recorded gesture to the musical note or sequence.

17. The system of claim 15, wherein each standard control signal is a MIDI control signal.

* * * * *